US008876554B2

(12) United States Patent
Drehmann

(10) Patent No.: US 8,876,554 B2
(45) Date of Patent: Nov. 4, 2014

(54) SHIELDING TERMINAL CLAMP

(75) Inventor: Gennadij Drehmann, Nürnberg (DE)

(73) Assignee: Siemens Aktiengesellschaft, Muenchen (DE)

( * ) Notice: Subject to any disclaimer, the term of this patent is extended or adjusted under 35 U.S.C. 154(b) by 315 days.

(21) Appl. No.: 13/538,129

(22) Filed: Jun. 29, 2012

(65) Prior Publication Data

US 2013/0005184 A1 Jan. 3, 2013

(30) Foreign Application Priority Data

Jun. 30, 2011 (EP) ..... 11172155

(51) Int. Cl.
*H01R 4/48* (2006.01)

(52) U.S. Cl.
CPC ..... *H01R 4/4872* (2013.01)
USPC ..... 439/607.01

(58) Field of Classification Search
USPC ..... 439/817, 818, 812, 814, 98, 607.01, 439/709, 441; 174/60
See application file for complete search history.

(56) References Cited

U.S. PATENT DOCUMENTS

| | | | | |
|---|---|---|---|---|
| 2,159,076 | A * | 5/1939 | Douglas | 200/533 |
| 3,304,392 | A * | 2/1967 | Isler | 337/152 |
| 4,416,500 | A * | 11/1983 | Stenz | 439/436 |
| 4,589,722 | A * | 5/1986 | Hall et al. | 439/813 |
| 4,929,198 | A * | 5/1990 | Strate et al. | 439/709 |
| 5,739,467 | A * | 4/1998 | Fabrizi | 174/60 |
| 6,328,580 | B2 * | 12/2001 | Hanning et al. | 439/98 |
| 7,172,470 | B2 * | 2/2007 | Takaya et al. | 439/811 |
| 7,354,319 | B2 * | 4/2008 | Camino et al. | 439/828 |
| 7,384,317 | B1 * | 6/2008 | Pijoan et al. | 439/814 |
| 7,909,633 | B1 * | 3/2011 | Miller et al. | 439/441 |
| 8,308,516 | B2 * | 11/2012 | Gassaur et al. | 439/817 |
| 8,591,269 | B2 * | 11/2013 | Furholzer | 439/819 |
| 2001/0039132 | A1 * | 11/2001 | Hanning et al. | 439/98 |
| 2008/0153362 | A1 * | 6/2008 | Pijoan et al. | 439/816 |
| 2013/0005184 | A1 * | 1/2013 | Drehmann | 439/607.01 |
| 2014/0113507 | A1 * | 4/2014 | Vanzetto | 439/812 |

FOREIGN PATENT DOCUMENTS

| | | |
|---|---|---|
| DE | 298 05 077 | 5/1998 |
| DE | 10 2007 016333 | 10/2008 |
| EP | 0 334 975 | 10/1989 |
| WO | WO 2007/053871 | 6/2007 |

* cited by examiner

*Primary Examiner* — Alexander Gilman
(74) *Attorney, Agent, or Firm* — Cozen O'Connor

(57) ABSTRACT

A shielding terminal clamp including a first side piece having a first guide device disposed along the first side piece, a second side piece, a U-shaped yoke having a base part having a second guide means disposed along the second side piece, an elastic element is disposed between the first side piece and the second side piece such that a compressive force is exerted onto a pressure piece that is movably mounted between the first and second guide means, and a first wing and second wing disposed on the pressure piece, wherein the first and second wings are configured to generate a counterforce with the fingers of a human hand against the compressive force and thereby compress the elastic element.

8 Claims, 2 Drawing Sheets

SHIELDING TERMINAL CLAMP

BACKGROUND OF THE INVENTION

1. Field of the Invention

The invention relates to cable clamps and, more particularly, to a shielding terminal clamp having a first side piece, a second side piece and a U-shaped yoke having a base part, where an elastic element is disposed between the first side piece and the second side piece such that a compressive force is exerted on a pressure piece.

A shielding terminal clamp within the meaning and scope of the invention is to be understood a clamping device by which it is possible to clamp a cable shield of a cable having signal lines to a shielding busbar and thereby allow a contact transition that exhibits the lowest possible impedance and resistance from the shielding braid by way of the shielding terminal clamp to a shielding busbar.

2. Description of the Related Art

European patent specification EP 0 334 975 B1 disclose a conventional shielding terminal clamp. A disadvantageous aspect in the case of this conventional shielding terminal clamp, however, is that time-consuming and labor-intensive assembly effort is necessary for connecting the shielding clamp and the shielding busbar.

SUMMARY OF THE INVENTION

It is therefore an object of the invention to provide a shielding terminal clamp with which installing a cable having a shielding braid onto a shielding busbar is made easier.

This and other objects and advantages are achieved in accordance with the invention by providing a shielding terminal clamp in which a first side piece includes a first guide disposed along the first side piece and the second side piece includes a second guide disposed along the second side piece, where a pressure piece is movably mounted between the first and second guide, a first end of the elastic element is disposed on a base part and a second end of the elastic element is disposed on the pressure piece such that a compressive force is directed in the direction of an open end of a yoke opposite the base part. In addition, the shielding terminal clamp includes a first wing and second wing disposed on the pressure piece, where the first and second wings are configured to generate a counterforce with the fingers of a human hand against the compressive force and thereby compress the elastic element. In this context, the term force is to be understood as constituting a vector quantity having direction and magnitude. Consequently, when reference is made here within the meaning and scope of the invention to a direction in relation to the force, then this is referred to the directional component of the aforesaid force subject to the consideration that forces are a vector quantity.

With the shielding terminal clamps in accordance with the invention, it is advantageous that there is present in the U-shaped yoke a slidingly mounted pressure piece that is pressed downward with a constant force by an elastic element having, for example, a spring, where the U-shaped configuration of the yoke enables one or more cables to be inserted into the space formed by the U, with the shielding braid of the cables already being exposed. The elastic element now ensures that the cable, together with its shielding braid, is pressed by the pressure piece in the direction of the open end, where when being clamped to a shielding busbar the shielding braid is disposed at the open end.

In contrast to the conventional shielding terminal clamps known, it is possible with the shielding terminal clamp in accordance with the invention, due to the first and second wings, which could also be described as two handles, to generate by a one-handed operator action a counterforce acting on the elastic element such that the inserted cables can fit into the space formed by the U and at the same time the shielding terminal clamp can be installed, and after the first and second wings are released the compressive force acts on the pressure piece such that the cables are clamped in position.

The wings are advantageously disposed in a through-opening formed by the U-shaped yoke.

For ease of installation on a shield busbar, it is advantageous if an arm is disposed in each case at right angles to the compressive force on the side pieces at the open end of the yoke opposite the base part and the arm is configured such that an interspace for accommodating a shield busbar is formed between the open end of the yoke and a long side of the arm. Here, the interspace is formed by retracting the elastic element with a human hand, where this being possible by a 3-finger operator action, the thumb exerts pressure on the base part, and where the index finger grips one wing and the middle finger grips another wing, and in this way can accommodate a shield busbar by the shielding terminal clamp being slid onto the shield busbar.

A counter bearing is disposed at the end of the arm to prevent the arm slipping out of position on the shield busbar.

In an advantageous embodiment, an implementation having two springs guided in parallel is used for the elastic element.

In another preferred embodiment, the pressure piece is configured as a sheet metal part having T-pieces and the T-pieces are guided in the guides configured as longitudinal slots.

In order to manufacture a shielding terminal clamp in accordance with the disclosed embodiments, it is advantageous if the pressure piece, the wings and the T-pieces are configured as a cohesive sheet metal part.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The drawing illustrates an exemplary embodiment of the shielding terminal clamp, in which.

DETAILED DESCRIPTION OF THE PREFERRED EMBODIMENTS

Figure 1:
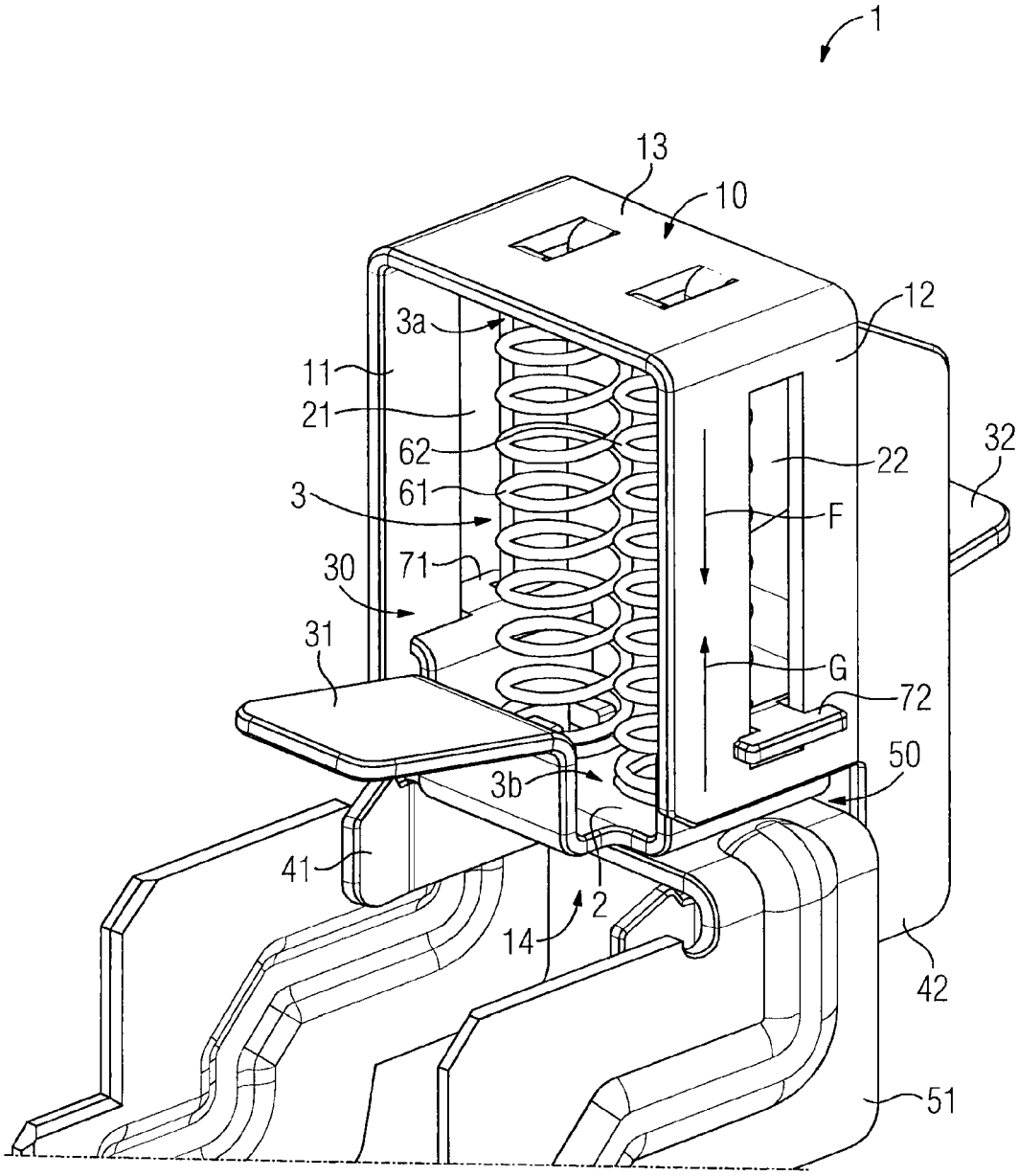
FIG. 1 shows the shielding terminal clamp in a perspective three-dimensional view.

With specific reference to FIG. 1, shown therein is a shielding terminal clamp 1 including a U-shaped yoke 10 having a first side piece 11, a second side piece 12 and a base part 13. An elastic element 3, i.e., a first spring 61 and a second spring 62, is provided for generating a compressive force F. The elastic element 3 is disposed between the first side piece 11 and the second side piece 12 such that the compressive force F is exerted onto a pressure piece 2. The first side piece 11 has a first guide 21 disposed along the first side piece 11 and the second side piece 12 has a second guide 22 disposed along the second side piece 12, where the first and second guides 21, 22 are disposed in the form of longitudinal slots in the first and second side pieces 11, 12. The pressure piece 2 includes a first T-piece 71 and second T-piece 72 is slidingly mountable in the longitudinal slots, and is thus prevented from slipping out of position. A first end 3*a* of the elastic element 3 is disposed on an inside face of the base part 13 and a second end 3*b* of the elastic element is disposed on an inside face of the pressure piece 2, where the arrangement enables the compressive force F to be directed in the direction of an open end 14 of the yoke 10 opposite the base part 13.

A first wing 31 and a second wing 32 are disposed in a through-opening 30 formed by the U-shaped yoke 10.

A first arm 41 and a second arm 42 are disposed at right angles to the compressive force F on the open end 14 of the yoke 10 to enable the terminal clamp to be pushed, clipped or clamped more easily onto a shield busbar 51. Here, the first arm and the second arm 42 are configured such that an interspace 50 for accommodating a shield busbar 51 is formed between the open end 14 of the yoke 10 and a first long side 41*a* of the first arm 41 and a second long side 42*a* of the second arm 42.

In order to symbolize the generation of a counterforce G, it should be understood that the shielding terminal clamp 1 is operable with one hand in a single-handed operator action. In this case, the thumb presses from above onto the shielding terminal clamp 1 such that the thumb is positioned on the base part 13 and the index finger grips under the first wing 31 and at the same time the middle finger of the human hand grips under the second wing 32, and as a result of pressing with the thumb or pulling with the two fingers the elastic element 3 is moved by the counterforce G against its compressive force F and in this way the interspace 50 can be exposed.

Figure 2:
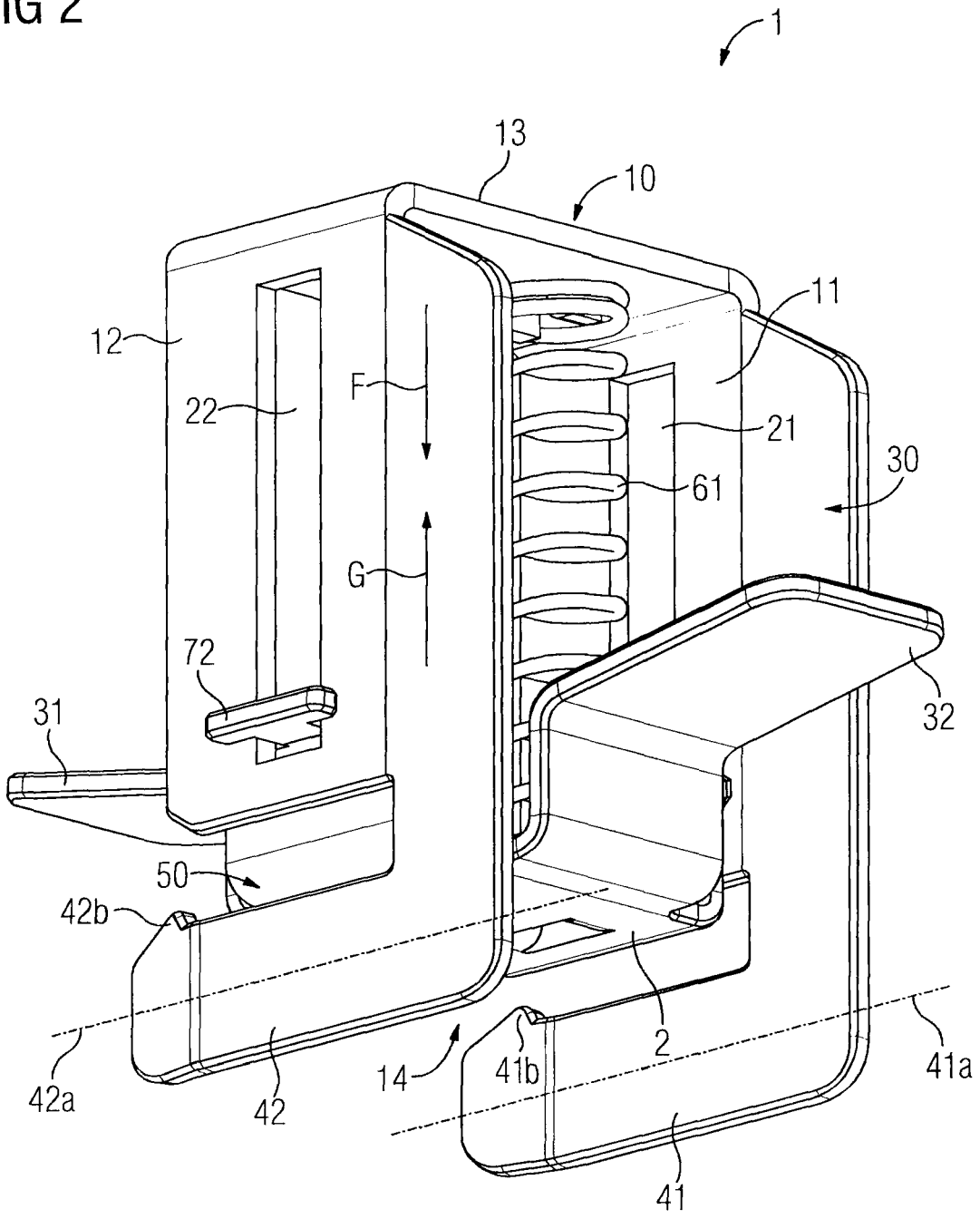
FIG. 2 shows the shielding terminal clamp known from FIG. 1 with an illustrated shield busbar.

Turning specifically to FIG. 1, shown therein is a shielding terminal clamp 1 mounted onto a shield busbar 51. All the individual parts and features of the shielding terminal clamp 1 in FIG. 2 correspond to the shielding terminal clamp 1 from FIG. 1, where the shielding terminal clamp 1 is merely rotated through 90° in the perspective view. In the illustration depicted in FIG. 2, no cables have as yet been inserted into the shielding terminal clamp 1, but when the counterforce G is generated by the first wing 31 and the second wing 32 with pressure onto the base part 13, the pressure piece 2 is displaced upward and cables with their shielding braid can be inserted between the pressure piece 2 and the shield busbar 51 and as a result of the first wing 31 and the second wing 32 being released the compressive force F allows the pressure piece 2 to press onto the shielding braid of the cables, which are accordingly securely clamped in position. A counter bearing 41*b*, 42*b* is disposed at the end of each arm 41, 42 to prevent the arms 41, 42 from slipping out of position on the shield busbar 51.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A shielding terminal clamp, comprising:

a U-shaped yoke having a base part, a first side piece having a first guide disposed along the first side piece, and a second side piece having a second guide disposed along the second side piece;

a pressure piece movably mounted between the first and second guides;

an elastic element disposed between the first side piece and the second side piece such that a compressive force is exerted onto the pressure piece, a first end of the elastic element being disposed on the base part and a second end of the elastic element being disposed on the pressure piece such that the compressive force is directed in a direction of an open end of the U-shaped yoke opposite the base part; and a first wing and a second wing disposed on the pressure piece, the first and second wings being configured to generate a digitally induced counterforce against the compressive force and thereby compress the elastic element.

2. The shielding terminal clamp as claimed in claim 1, wherein the U-shaped yoke forms a through-opening, the first and second wings being disposed in the through-opening formed by the U-shaped yoke.

3. The shielding terminal clamp as claimed in claim 1, further comprising:

an arm disposed at right angles to the compressive force on the first and second side pieces, respectively, at the open end of the yoke opposite the base part;

wherein the arm is configured such that an interspace for accommodating a shield busbar is formed between the open end of the yoke and a long side of the arm.

4. The shielding terminal clamp as claimed in claim 2, further comprising:

an arm disposed at right angles to the compressive force on the first and second side pieces, respectively, at the open end of the yoke opposite the base part;

wherein the arm is configured such that an interspace for accommodating a shield busbar is formed between the open end of the yoke and a long side of the arm.

5. The shielding terminal clamp as claimed in claim 3, further comprising:

a counter bearing disposed at the end of the arm.

6. The shielding terminal clamp as claimed in claim 1, wherein the elastic element comprises two springs guided in parallel.

7. The shielding terminal clamp as claimed in claim 1, wherein the pressure piece comprises a sheet metal part having T-pieces guided in the guides configured as longitudinal slots.

8. The shielding terminal clamp as claimed in claim 7, wherein the pressure piece, the first and second wings and the T-pieces are formed by a single cohesive sheet metal part.

* * * * *